US005674042A

United States Patent [19]

Gerritse

[11] Patent Number: 5,674,042

[45] Date of Patent: Oct. 7, 1997

[54] APPARATUS FOR EMPTYING CONTAINERS

[75] Inventor: Jan Gerritse, Brummen, Netherlands

[73] Assignee: Gerritse Beheer B.V., Brummen, Netherlands

[21] Appl. No.: 742,443

[22] Filed: Nov. 1, 1996

Related U.S. Application Data

[63] Continuation of Ser. No. 358,893, Dec. 19, 1994, abandoned.

[30] Foreign Application Priority Data

Dec. 20, 1993 [NL] Netherlands ..... 9302218
Mar. 15, 1994 [NL] Netherlands ..... 9400403

[51] Int. Cl.[6] ..... B65B 69/00

[52] U.S. Cl. ..... 414/420; 15/58; 15/93.1; 414/422; 414/425

[58] Field of Search ..... 414/409, 419, 414/420, 424, 425; 366/63; 15/56, 57, 58, 93.1, 104.05

[56] References Cited

U.S. PATENT DOCUMENTS

| | | | |
|---|---|---|---|
| 1,357,003 | 10/1920 | Reynolds | 414/420 |
| 2,115,439 | 4/1938 | Wolfner | 15/58 |
| 2,838,291 | 6/1958 | Peebles | 366/63 |
| 2,870,927 | 1/1959 | Warren | 414/420 |
| 3,905,061 | 9/1975 | Cradeur | 15/104.05 |
| 4,126,910 | 11/1978 | Beer | 15/56 |
| 4,145,954 | 3/1979 | Schilder | 90/11 |
| 4,149,292 | 4/1979 | Dietrich et al. | 15/56 |
| 5,193,241 | 3/1993 | Meisingseth et al. | 15/93.1 |
| 5,417,169 | 5/1995 | Carpenter | 110/222 |

FOREIGN PATENT DOCUMENTS

| | | | |
|---|---|---|---|
| 1412572 | 8/1965 | France | 414/425 |
| 1432998 | 10/1969 | Germany . | |
| 2704977 | 9/1977 | Germany . | |
| 7504751 | 10/1976 | Netherlands . | |
| 806081 | 12/1958 | United Kingdom . | |

*Primary Examiner*—Thomas J. Brahan

[57] ABSTRACT

An apparatus for cleaning a rotation-symmetrical container with a mouth which comprises:

positioning means for placing and holding a container in a raised inclined position such that the mouth is situated on the underside;

first drive means for rotating the container round its centre line; and scraping means for placing into the container and drivable in the direction of the centre line thereof by means of the second drive means, such that during the action of the first and the second drive means the inner surface of the container is scraped clean.

4 Claims, 2 Drawing Sheets

APPARATUS FOR EMPTYING CONTAINERS

This application is a continuation of application Ser. No. 08/358,893 filed on Dec. 19, 1994, now abandoned.

BACKGROUND OF THE INVENTION

1. Field of the Invention

The invention lies in the field of the emptying of containers.

2. Description of the Prior Art

It is known to spray an inner surface clean by means of medium under pressure, for example water. Use is also made of a piston which is somewhat flexible at least on its periphery and which can move along the inner surface of the container. Particularly the viscous residual mass in the container scraped off by the piston is drained by means of suction means.

The object of the invention is to provide an emptying apparatus which combines a simple construction with a great efficiency of operation.

SUMMARY OF THE INVENTION

In respect of the above, the invention provides an apparatus for emptying a rotation-symmetrical container with a mouth, which apparatus comprises:

positioning means for placing and holding a container in a raised inclined position such that the mouth is situated on the underside;

first drive means for rotating the container round its centre line; and scraping means for placing into the container and drivable in the direction of the centre line thereof by means of a second drive means, such that during the action of the first and the second drive means the inner surface of the container is scraped clean.

With such an apparatus a container can be emptied and a mass present therein, for instance a viscous residual mass, can be removed without being contaminated or mixed with other substances such as a cleaning liquid, while the residual mass can be poured in a controlled way into a collecting tank, for instance for re-use.

In order to enable the apparatus to operate as automatically as possible, the apparatus can be provided with lifting means for placing a container in the raised position. The lifting means control the angle of inclination of the container and therewith the dosing speed.

In order to ensure a positive driving which is as free of slip as possible, also in the case of relatively light, for instance plastic, containers, the apparatus can have the special feature that the drive means comprise at least one free-turning pressure roller for pressing against the container in addition to a drive face, for instance the outer surface of a drive roller, for pressing against the container.

Found to be very effective in this respect is the embodiment wherein the drive face is the surface of an endless strap, belt or cord.

A very effective scraping action is ensured with an embodiment wherein the scraping means comprise a flexible scraper. A flexible scraper has the further advantage that it adapts itself easily to the shape of the inner surface of a container. This is a particular advantage in the case of non-cylindrical containers.

A preferred embodiment has the special feature that lifting means also comprise the positioning means.

BRIEF DESCRIPTION OF THE DRAWINGS

The invention will now be elucidated with reference to the annexed drawing, in which.

DESCRIPTION OF THE PREFERRED EMBODIMENTS

Figure 1:
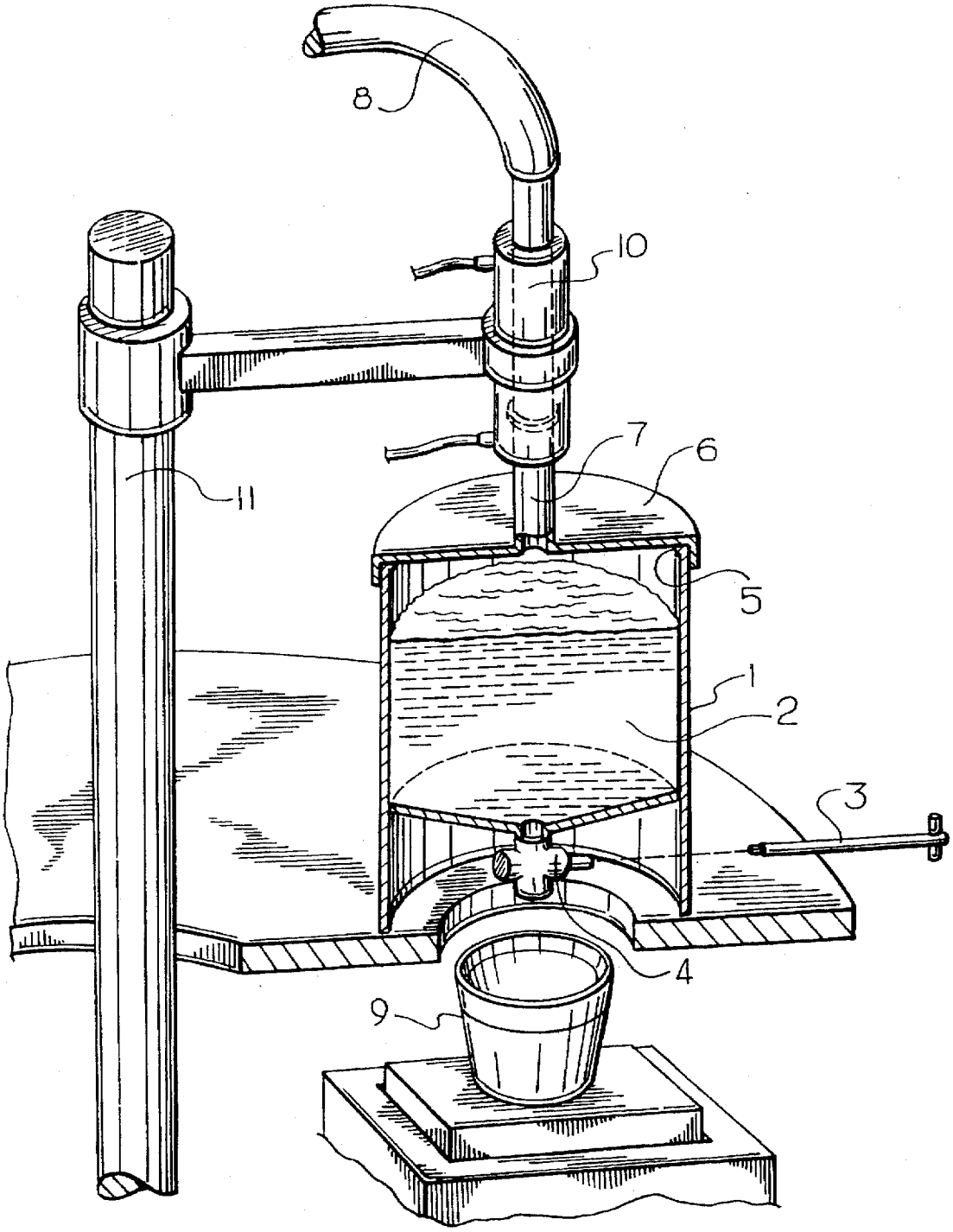
FIG. 1 shows a device for metered delivery of a liquid or pasty mass from a container, partly in perspective view, partly in cross section.

FIG. 1 shows a vessel 1 which is filled with a pasty mass 2. For metered delivery of this mass 2 the vessel 1 is provided on its underside with a tap 4 to be opened by an operating handle 3. On the top side the mouth of vessel 1 defined by the upper edge 5 can be closed by means of a cover 6 which connects to a compressed air source by means of a tube 7 and a flexible conduit 8 connecting thereto. In this way the contents of vessel 1 can be placed under pressure. By operating the handle 3, mass 2 dosed via the tap 4 can be delivered to a receiving holder 9. By means of a pneumatic cylinder 10 with a hollow continuous rod, the cover 6 can be moved up and downward. A downward directed pressure force can also be exerted in this way by the cover 6 on the edge 5 provided with sealing means.

The cylinder 10, and therewith cover 6, can be supported by a frame 11.

Figure 2:
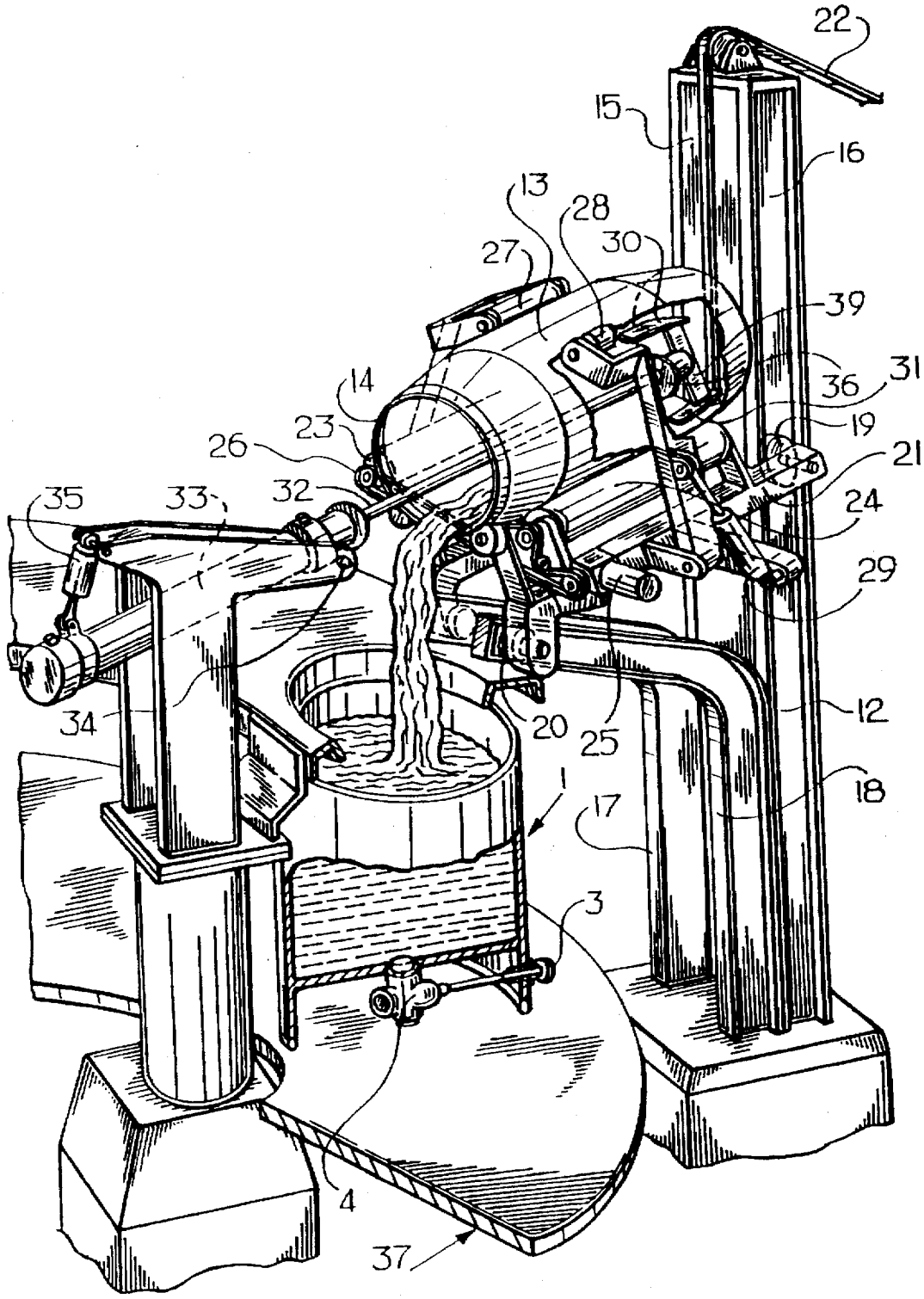
FIG. 2 is a partly broken away perspective view of a cleaning apparatus according to the invention.

FIG. 2 shows a cleaning apparatus 12 according to the invention. The apparatus is suitable for cleaning a rotation-symmetrical container 13 of substantially random shape and dimensions. The container 13 has a mouth 14. A frame comprises four rails, respectively 15, 16 and 17, 18 along which wheels respectively 19, 20 can roll. Wheels 19, 20 bear a carriage 21. A cable 22 serves to displace carriage 21 up and downward. In the lower rest position (not shown) the carriage 21 extends vertically. In this position, the container 13 can be placed in the carriage 21. The container 13 is then supported against two rollers 23, 24 and a belt 26 driven by a motor 25. The belt is pressed resiliently inward to make intensive contact with the outer surface of container 13 by pressing two free-turning rollers 27, 28 on the outside of the container. These rollers are carried into the position shown in FIG. 2 by pneumatic cylinders 29.

Due to the curved form of the rails 17, 18 as according to FIG. 2, a tilting of the container 13 to the shown position takes place during the upward directed displacement of carriage 21 due to exerting of a tensile force on the cable 22. In this position, the mouth 14 located on the underside is accessible to a scraper 39 with two flexible scraper blades 30, 31. The scraper 39 is carried by the piston rod 32 of a hydraulic or pneumatic cylinder 33 which is pivotally suspended in a hinge 34 and assumes an angular position which is determined by the energizing situation of a cylinder 35. By simultaneously energizing motor 25 and cylinder 33 there takes place an urged rotation of container 13 on the one hand and an axial displacement of scraper blades 30, 31 on the other, whereby the whole inner surface of the container is cleaned in a helical scanning movement. The bottom is cleaned by the scraper 39. A flange 36 serves as a leakage ring.

The drawn embodiment according to FIG. 2 can also be embodied such that the belt 36 serves to drive rollers 23, 24 and has itself no driving function.

The scraped-off mass leaves the container 13 via the mouth 14 and is poured into the vessel 1 placed thereunder.

This vessel 1 can be further transported via a conveyor 37 to the device according to FIG. 1.

I claim:

1. An apparatus for emptying a rotation-symmetrical container having a mouth, comprising:

a frame having a plurality of rails;

a carriage for holding the container, wherein said carriage is displaceable along said rails;

a cable attached to said carriage to displace said carriage along said rails;

first drive means for rotating the container around a center line of the container; and scraping means insertable into the container and drivable in a direction of a center line thereof by means of a second drive means, such that through the action of the first and second drive means the container is emptied, wherein said rails are configured such that said carriage is displaceable from a first position in which the container is oriented substantially vertically to a second position in which the container is inclined such that the container mouth is oriented substantially downwardly, wherein said scraping means includes a flexible scraper having a plurality of scraper blades, said second drive means includes a first cylinder having a piston rod, a first end and a second end, said scraper is attached to said piston rod of said first cylinder, said first end of said first cylinder is pivotally attached to a hinge and said second end of said first cylinder is attached to a second cylinder such that upon energizing said second drive means and said second cylinder, said first end of said second cylinder pivots with respect to said hinge such that said scraper performs a helical movement within the container.

2. The apparatus as claimed in claim 1, wherein said carriage includes at least one drive roller configured to press against the container.

3. The apparatus as claimed in claim 1, wherein said first drive means includes at least one free-turning pressure roller configured to press against the container and a drive face configured to press against the container.

4. The apparatus as claimed in claim 3, wherein said drive face is a surface of an endless belt.

* * * * *